United States Patent [19]

Conrad

[11] 4,001,744

[45] Jan. 4, 1977

[54] ELECTRICAL SWITCH

[75] Inventor: Richard A. Conrad, San Marcos, Calif.

[73] Assignee: Teledyne, Inc., Los Angeles, Calif.

[22] Filed: July 7, 1975

[21] Appl. No.: 593,739

[52] U.S. Cl. ..... 335/205; 335/206

[51] Int. Cl.[2] ..... H01H 9/02

[58] Field of Search ..... 335/205, 206, 207, 78, 335/81, 82

[56] References Cited

UNITED STATES PATENTS

| | | | |
|---|---|---|---|
| 3,052,774 | 9/1962 | Pike | 335/205 X |
| 3,261,941 | 7/1966 | Shlesinger | 335/205 |
| 3,397,372 | 8/1968 | Maxwell | 335/205 |

*Primary Examiner*—George Harris
*Attorney, Agent, or Firm*—Ronald W. Reagin

[57] ABSTRACT

An electrical switch is disclosed which includes a first and second pair of pole pieces and an armature mounted to move freely between the first pair of pole pieces and the second pair of pole pieces. A magnet is provided which is supported for movement between the first pair of pole pieces and the second pair of pole pieces. When the magnet is moved from one position to the other, the flux is switched from one pair of pole pieces to the other pair of pole pieces and the armature moves from one pair of pole pieces to the other pair of pole pieces.

7 Claims, 3 Drawing Figures

ELECTRICAL SWITCH

The present invention relates to electrical switches, and more particularly to an improved electrical switch which utilizes a novel structure for switching magnetic flux to provide such a switch which has a snap action and essentially no contact bounce.

The present invention was developed to fulfill a need for a simple, inexpensive to manufacture electrical switch for use in relatively hostile environments such as in space. There has been a particular need for such switches which provide a precise, snap action when the switch is actuated, and which are essentially immune to contact bounce, both at the time the switch is actuated and when the switch is subjected to high acceleration forces.

It is accordingly an object of the present invention to provide an improved electrical switch.

It is another object of the present invention to provide an improved electrical switch which has a minimum number of moving parts and which is inexpensive to manufacture.

It is another object of the present invention to provide an improved electrical switch which utilizes magnetic attraction to provide a positive, snap action and to prevent contact bounce.

Briefly stated, and in accordance with the presently preferred embodiment of the invention, an electrical switch is provided which includes at least one pair of electrical contact elements which are to be opened and closed when the switch is actuated. The switch includes a first pair of magnetic pole pieces having a first air gap therebetween and a second pair of magnetic pole pieces having a second air gap therebetween. Controllable means are provided for establishing a magnetic field in a selected one of the air gaps, and for switching the magnetic field from one air gap to the other. The controllable means includes a magnetic member which is supported for movement between a first position between the first pair of pole pieces and a second position between the second pair of pole pieces. The switch includes means responsive to the magnetic member being in its first position for establishing a magnetic field in one of the air gaps, and to the magnetic member being in its second position for establishing a magnetic field in the other of the air gaps. The switch includes means for selectively moving the magnetic member between its first and second positions. In the preferred embodiment of the invention, the magnetic member is itself a permanent magnet, although in other embodiments disclosed and described below, the magnet is permanently mounted, and the magnetic member is a movable magnetic keeper formed from low reluctance material. The switch further includes an armature, which is supported such that it can move between a first position in contact with both of the first pair of pole pieces and a second position in contact with both of the second pair of pole pieces, whereby when the controllable means establishes a magnetic field in the first air gap, the armature is attracted to its first position, and when the magnetic field is established in the second air gap, the armature is attracted to its second position. Circuit means are provided responsive to the position of the armature for opening and closing an electrical circuit between the pair of contact elements.

For a complete understanding of the invention, together with an appreciation of its other objects and advantages, please refer to the following detailed description of the attached drawings, in which.

Figure 1:
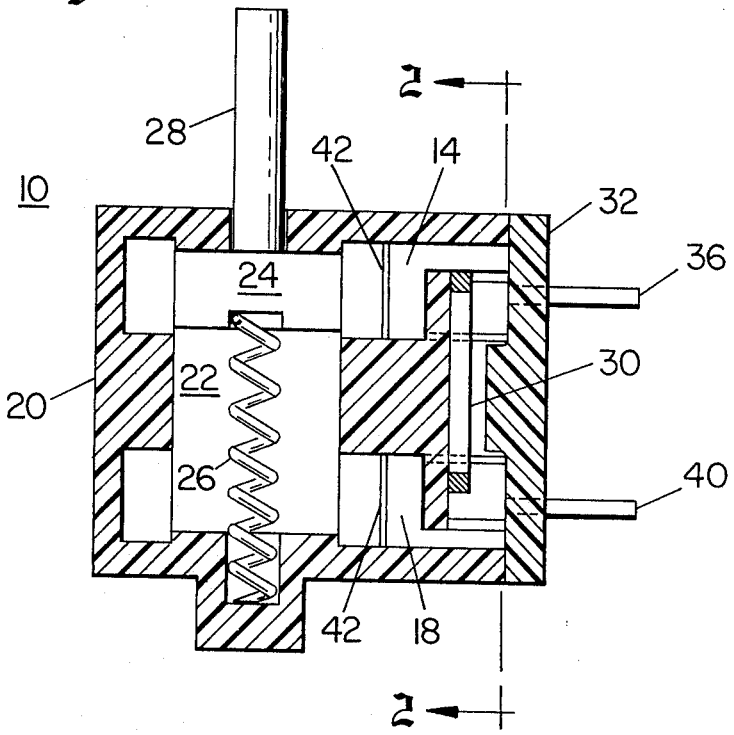
FIG. 1 is a side view, partially in cross-section, of an electrical switch in accordance with the presently preferred embodiment of the invention.
Figure 2:
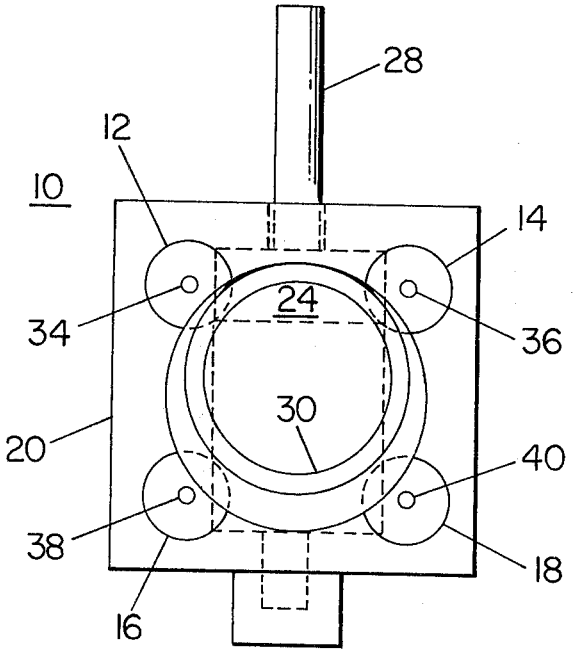
FIG. 2 is a sectional view taken along the lines 2—2 in FIG. 1.

FIG. 1 shows a cut-away side view, partially in cross-section, of an electrical switch 10 in accordance with the present invention and FIG. 2 shows a sectional view taken along the lines 2—2 in FIG. 1. The following description of this embodiment is of FIGS. 1 and 2 simultaneously, with the same reference numerals being used in each drawing to indicate the same part or component.

The electrical switch 10 includes a first pair of magnetic poles pieces 12 and 14 and a second pair of magnetic pole pieces 16 and 18, which are formed from any desired low reluctance material. The first pair of pole pieces 12 and 14 defines a first air gap therebetween, and the second pair of pole pieces 16 and 18 defines a second air gap therebetween. The pole pieces 12, 14, 16 and 18 are supported by a body member 20 which is formed from a non-magnetic, electrically insulating material, such as any suitable molded plastic or the like.

Positioned within a cavity 22 in the body 20 is a permanent magnet 24. The magnetic axis of magnet 24 is normal or perpendicular to the plane of FIG. 1 and parallel to the plane of FIG. 2. The magnet 24 is supported by the walls of the cavity 22 and the return spring 26 such that it is normally in a first position which is shown in FIGS. 1 and 2, with the magnet 24 in contact with the pole pieces 12 and 14, thereby establishing a magnetic field in the first air gap defined by this first pair of pole pieces 12 and 14. However, the magnet 24 is movable within the cavity 22, such as by pushing on the plunger 28, to move the magnet 24 down to a second position (not shown in the Figures) in contact with the second pair of pole pieces 16 and 18. At this time, the magnet 24 establishes a magnetic field in the second air gap defined by the pole pieces 16 and 18. When the plunger 28 is released, the spring 26 returns the magnet 24 to its first position.

An armature 30 is provided, which in the shown embodiment has the shape of a ring. In the preferred embodiment, the armature 30 is freely positioned for movement in the space between the pole pieces 12, 14, 16 and 18, and is confined in this generally cylindrical space by the body 20 and an end cap 32, which is also formed from a non-conductive, non-magnetic material such as the same molded plastic out of which the body 20 is formed. The armature 30 is formed from any suitable low reluctance material, and for the reasons described in more detail below, is preferably coated with a thin coating of high electrically conductive material, such as gold or the like, to provide good electrical connection to the pole pieces. This coating also provides a thin gap of non-magnetic material between the pole pieces and the magnetic portion of the armature.

The switch 10 also includes a first pair of electrical contact elements 34 and 36, each of which extends through the cover 32 and is electrically connected to a respective one of the first pair of pole pieces 12 and 14. Similarly, a second pair of electrical contact elements 38 and 40 are provided, each of which is electrically connected to a respective one of the second pair of pole pieces 16 and 18.

The operation of the switch 10 is as follows: When the plunger 28 is not depressed, the magnet 24 is in its first position as shown in the Figures, and it establishes magnetic flux between the ends of the first pair of pole pieces 12 and 14. This flux attracts the armature 30 upward to the position shown in the Figures, at which time the armature 30 makes good electrical contact between the pole pieces 12 and 14, thereby completing an electrical circuit between the first pair of electrical contact elements 34 and 36. At this time, the armature 30 does not contact the second pair of pole pieces 16 and 18, and no circuit is completed between these pole pairs. Thus, there is an open circuit between the second pair of electrical contact elements 38 and 40.

It is usually desirable to provide electrical insulation between the ends of the pole pieces, in order to prevent the pole pieces from being shorted together if a conductive magnet is used, or if, instead of molded plastic, the body 20 is formed from a nonmagnetic metal such as bronze. This can be done, for example, by cutting the pole pieces, 12, 14, 16 and 18 into two portions each and by inserting a thin film 42 of insulating material between the two portions. The thickness of the film 42 is exaggerated in FIG. 1, in order that it may be clearly shown. In practice, its thickness is usually only one to two thousandths of an inch.

When the plunger 28 is depressed, the magnet 24 is moved within the cavity 22 to its second position in contact with the second pair of pole pieces 16 and 18. This establishes a magnetic field in the second air gap between the second pair of pole pieces 16 and 18. This magnetic field attracts the armature 30 downward to its second position (also not shown in the Figures) in contact with the second pair of pole pieces 16 and 18. This completes an electrical circuit between the second pair of electrical contact elements 38 and 40, and also simultaneously breaks the electrical circuit between the first pair of electrical contact elements 34 and 36.

Those skilled in the art will appreciate that the structure just described easily meets the above-described objects of the present invention. The switch 10 is simple in structure and easy to manufacture, with only two moving pieces, the magnet 24 and the armature 30. The magnetic forces act on the armature 30 such that, when the plunger 28 is depressed to move the magnet 24, the armature 30 moves to its second position with a positive snap action, and contact is completed with a minimum of contact bounce, since the magnetic forces also hold the armature 30 against the pole pieces while completing the electrical circuit. Similarly, if the switch is subject to vibrational or other acceleration forces, the magnetic forces holds the armature 30 firmly against whatever pair of pole pieces it is then against, again minimizing or entirely eliminating the contact bounce problem.

Figure 3:
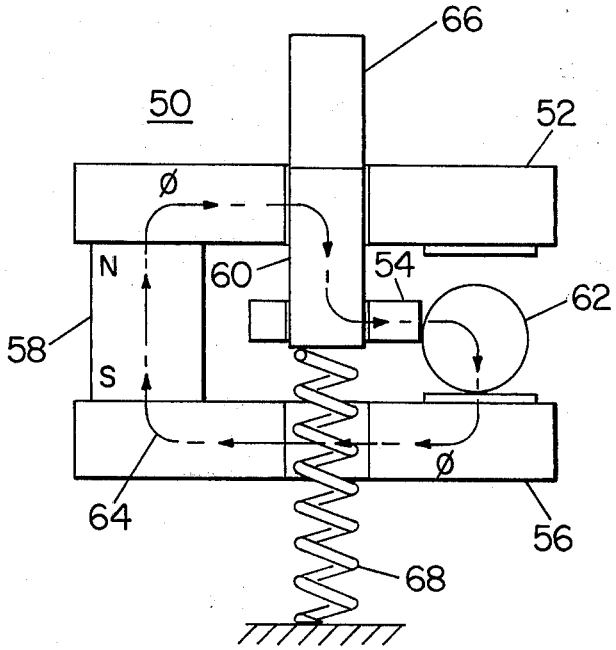
FIG. 3 is a schematic representation of a second embodiment of the present invention.

FIG. 3 is a schematic representation of a second embodiment of the present invention and illustrates several modifications which can be made within the general principals of the invention. In the embodiment of FIG. 3, the switch 50 includes a first magnetic pole piece 52, a second magnetic pole piece 54 and a third magnetic pole piece 56. The first pair of pole pieces consists of the pole pieces 52 and 54, which define a first air gap. The second pair of pole pieces consists of the pole pieces 54 and 56, which define a second air gap.

A permanent magnet 58 is provided which, were it not for the magnetic keeper 60, would establish a magnetic field in both of the air gaps, with the magnetic field passing from the pole piece 52 to the pole piece 54 to the pole piece 56 and back to the magnet 58. However, a keeper 60 is provided which is formed from a low reluctance material and which is supported from movement through aligned openings in the pole pieces 52, 54 and 56 from a first position as shown in FIG. 3 to a second position (not shown in FIG. 3) between the pole piece 54 and pole piece 56.

An armature 62 is provided, which in the shown embodiment is either a sphere or a cylinder. With the keeper 60 in its shown first position, a flux path 64 is established by the permanent magnet 58 which passes through the second air gap between the second pair of pole pieces 54 and 56. This magnetic flux attracts the armature 62 to the position shown in FIG. 3, thereby completing electrical contact between the pole pieces 54 and 56.

If the keeper 60 is moved to its second position between the pole pieces 54 and 56, such as by depressing the plunger 66, which is made from some non-magnetic material, the flux path 64 is obviously switched into the first air gap between the first pair of poles pieces 52 and 54, since the second air gap is now being shunted by the keeper 60. At this time, the magnetic force attracts the armature 62 upward into its second position (not shown in FIG. 3) between the first pole piece 52 and the second pole piece 54, thereby completing an electrical circuit between this first pair of pole pieces.

A return spring 68 returns the keeper 60 to its first position when any force or pressure is removed from the plunger 66.

Again, those skilled in the art will appreciate that the switch shown in FIG. 3 is one which would be simple and inexpensive to manufacture, since it has a minimum of components, and since only two of the components are moving parts. Further, the magnetic forces will again provide a snap action when the switch is actuated and will hold the armature in the desired position if the switch is subjected to vibration or other acceleration forces.

While the invention is thus disclosed, and two embodiments described in detail, the invention is not limited to the shown embodiments. Instead, many modifications will occur to those skilled in the art which lie within the spirit and scope of the invention. It is thus intended that the invention be limited in scope only by the appended claims.

What is claimed is:

1. An electrical switch comprising: in combination:
at least one pair of electrical contact elements;
a first pair of magnetic pole pieces having a first air gap therebetween;
a second pair of magnetic pole pieces having a second air gap therebetween
controllable means for establishing a magnetic field in a selected one of the first and second air gaps, the controllable means including:
a magnetic member;
support means for supporting the magnetic member in a first position between the first pair of pole pieces and a second position between the second pair of pole pieces;

means for supporting the first and second pair of magnetic pole pieces relative to the magnetic member such that when the magnetic member is in its first position, a magnetic field is established in one of the first and second air gaps and when the magnetic member is in its second position, a magnetic field is established in the other of the first and second air gaps; and means for selectively moving the magnetic member between its first and second positions; an armature;

armature support means for supporting the armature such that it can move between a first position in contact with both of the first pair of pole pieces and a second position in contact with both of the second pair of pole pieces, whereby when the controllable means establishes a magnetic field in the first air gap, the armature is attracted to its first position, and when the controllable means establishes a magnetic field in the second air gap, the armature is attracted to its second position; and circuit means responsive to the position of the armature for opening and closing an electrical circuit between the pair of electrical contact elements.

2. The electrical switch of claim 1 in which the magnetic member is a magnet, whereby when the magnet is in its first position, a magnetic field is established in the first air gap, and when the magnet is in its second position a magnetic field is established in the second air gap.

3. The electrical switch of claim 1 in which the magnetic member is a keeper formed from low reluctance material and in which the switch further includes means for establishing a magnetic field in both of the first and second air gaps, whereby when the keeper is in its first position, it shunts the magnetic field from the first air gap, and when the keeper is in its second position, it shunts the magnetic field from the second air gap.

4. The electrical switch of claim 1 in which the first pair of pole pieces comprises a first pole piece and a second pole piece and the second pair of pole pieces comprises the second pole piece and a third pole piece.

5. The electrical switch of claim 1 in which the armature support means comprises means for confining the armature to the space between the pole pieces while allowing the armature to move freely within that space.

6. The electrical switch of claim 1 in which the circuit means comprises the armature being formed from electrically conductive material, one of the electrical contact elements being connected to one of the first pair of pole pieces and the other of the electrical contact elements being connected to the other of the first pair of pole pieces, whereby when the armature is in its first position, it completes an electrical circuit between the pair of electrical contact elements.

7. The electrical switch of claim 6 which further includes a second pair of electrical contact elements, one of the second pair of electrical contact elements being connected to one of the second pair of pole pieces and the other of the second pair of electrical contact elements being connected to the other of the second pair of poles pieces, whereby when the armature is in its second position, it completes an electrical circuit between the second pair of electrical contact elements.

* * * * *